US008245645B1

(12) United States Patent
Paulic et al.

(10) Patent No.: US 8,245,645 B1
(45) Date of Patent: Aug. 21, 2012

(54) MINE-DEFEATING PROJECTILE

(75) Inventors: Antonio Paulic, Arlington, VA (US); Lance Benedict, McLean, VA (US)

(73) Assignee: Lockheed Martin Corporation, Grand Prairie, TX (US)

( * ) Notice: Subject to any disclaimer, the term of this patent is extended or adjusted under 35 U.S.C. 154(b) by 382 days.

(21) Appl. No.: 12/702,429

(22) Filed: Feb. 9, 2010

Related U.S. Application Data

(60) Provisional application No. 61/151,294, filed on Feb. 10, 2009.

(51) Int. Cl.
*F42B 12/22* (2006.01)

(52) U.S. Cl. ..... 102/477; 102/399; 102/497

(58) Field of Classification Search ..... 102/477, 102/399, 491, 494, 497, 473
See application file for complete search history.

(56) References Cited

U.S. PATENT DOCUMENTS 6,540,175 B1 * 4/2003 Mayersak et al. ..... 244/3.15
2008/0011179 A1 * 1/2008 Michel et al. ..... 102/275
* cited by examiner

*Primary Examiner* — Michael Carone
*Assistant Examiner* — John D Cooper
(74) *Attorney, Agent, or Firm* — Slater & Matsil, L.L.P.

(57) ABSTRACT

A mine defeating projectile includes a housing defining an inner cavity, a plurality of channels extending through a front surface of the housing and to the inner cavity, and a plurality of cutout sections extending through as side wall thereof. The projectile further includes a fragmentation sleeve disposed in the inner cavity of the housing and a slider sleeve disposed in the inner cavity of the housing abutting an aft end of the fragmentation sleeve. The slider sleeve includes an explosive train and the slider sleeve is frangibly attached to the housing. The projectile further includes a finned section attached to an aft end of the housing. The finned section defines a protrusion for initiating the explosive train. The protrusion is spaced apart from the explosive train.

16 Claims, 8 Drawing Sheets

MINE-DEFEATING PROJECTILE

CROSS-REFERENCE TO RELATED APPLICATIONS

This application claims the benefit of U.S. Provisional Patent Application No. 61/151,294; filed 10 Feb. 2009; and entitled "Mine-Defeating Projectile," which is hereby expressly incorporated herein by reference for all purposes.

BACKGROUND

1. Field of the Invention

The present invention relates generally to submunitions, and particularly to small-scale submunitions used in mine destruction applications.

2. Description of Related Art

The use of small-scale projectiles capable of individually defeating land or under-water mines has proven to be a successful method of neutralizing mines within a coverage area. In order to ensure destruction of a mine, current systems require the explosive payload of the projectile to be detonated while intimately coupled with the energetic fill of the mine. Moreover, in order to successfully defeat a mine, current projectiles must employ high energy explosive material of such quantity that a safe and arm mechanism is required to be integrated to meet modern safety standards. Traditional safe and arm mechanisms suffer problems including failing to fit within the housing of small-scale projectiles. Improvements to small-scale projectiles capable of defeating mines are thus desired.

There are many designs of submunitions used in mine destruction applications well known in the art, however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
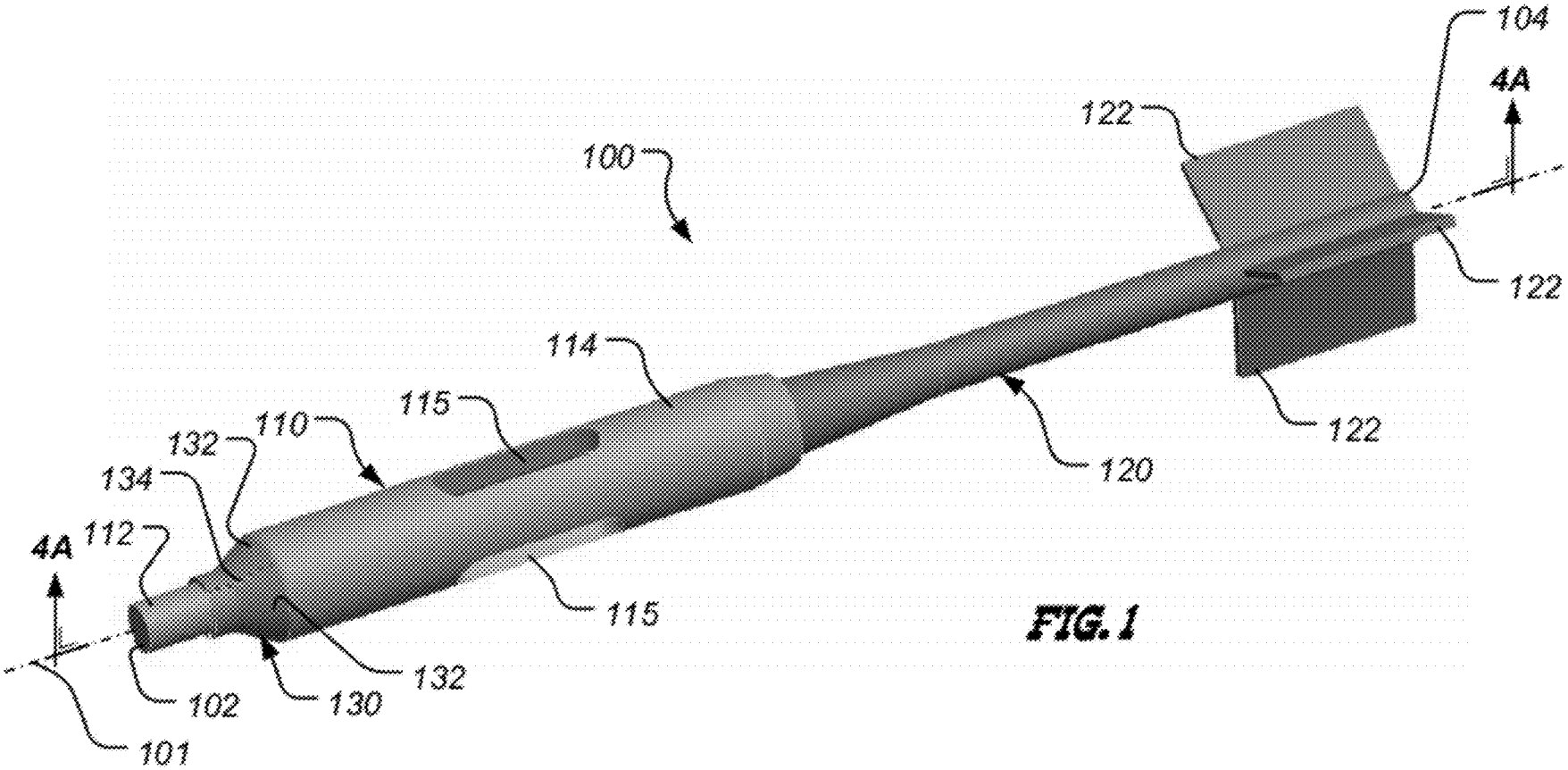
FIG. 1 is a diagram illustrating an isometric view of a projectile in accordance with an exemplary embodiment of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Reference will now be made in detail to the present exemplary embodiments of the invention, examples of which are illustrated in the accompanying drawings.

Referring to FIG. 1, a side and top view of a projectile 100 is shown in accordance with an exemplary embodiment of the invention. The projectile 100 has a generally cylindrical body, symmetrical in rotation about an axis 101. The projectile 100 has a forward end 102 and an aft end 104. The projectile comprises a housing 110 having a blunt nose section 112 located at a forward end of the housing 110 and a main body 114. The blunt nose section 112 has a flat forward face for allowing the projectile to supercavitate when traveling through water and to create a terra-dynamic cavity when traveling through sand or other such earthen materials. The main body 114 of the projectile housing 110 includes a plurality of cutout sections labeled generally as 115. The cutout sections 115 are configured to allow projectile fragments to be expelled from an inner cavity of the housing 110 after mine impact. By way of example only, the projectile housing 110 may be comprised of tungsten. The projectile 100 further comprises a frangible barrier 130 having a plurality of sections labeled generally as 132 separated by perforations 134 (only one labeled for clarity). The frangible barrier 130 is symmetrically disposed about an aft end of the blunt nose section 112 and a forward end of the housing 110. The perforations 134 separating each section 132 of the frangible barrier 130 are sized to hold the frangible barrier intact while traveling through water or sand overburdens and to detach upon impact with a mine casing, such as a metal mine casing, or a mine's energetic fill. By way of example only, the frangible barrier 130 may be comprised of aluminum, such as 7075-T6 aluminum.

Still referring to FIG. 1, the projectile 100 further comprises a finned section 120 located aft of the projectile housing 110. The finned section 120 includes a plurality of fins 122 located proximate the aft end of the finned section. The finned section 120 may also be comprised of aluminum, such as 7075-T6 aluminum. By way of example only, the projectile 100 may be approximately 5.5 inches in length and have an outer diameter of about 0.44 inches. In one configuration, the projectile weighs approximately 56 grams. The projectile 100 may also have a center of gravity located approximately 1.7 inches aft of the forward end 102 of the projectile 100. It is noted that the scale of the projectile is in no way limited to the exemplary embodiment and may be reduced or extended in size.

Figure 2:
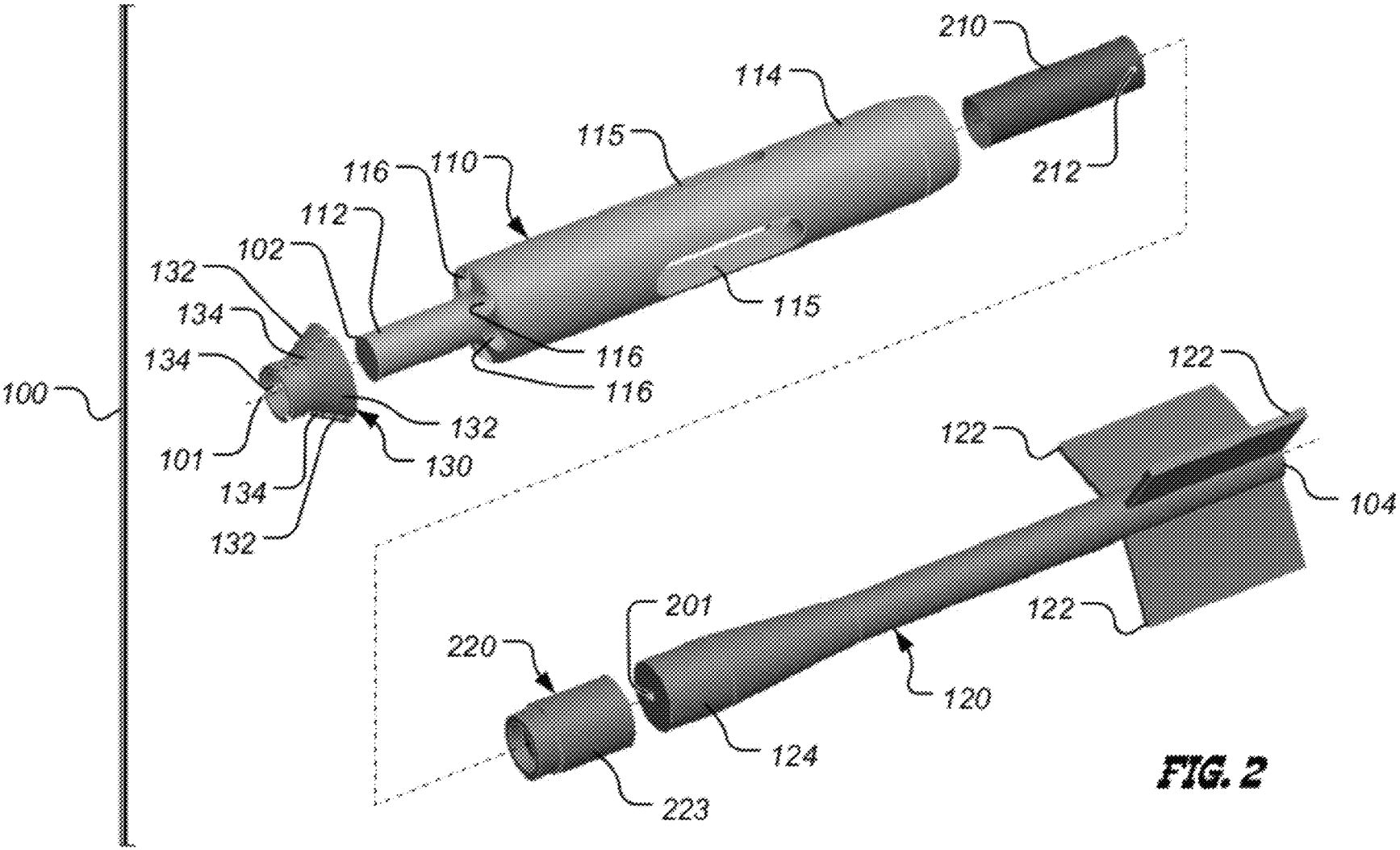
FIG. 2 is a diagram illustrating an exploded view of the exemplary projectile of FIG. 1.

Referring now to FIG. 2, a diagram is shown illustrating an exploded view of the exemplary projectile 100 of FIG. 1. As shown, the projectile housing 110 further comprises a plurality of cylindrical cutouts 116 symmetrically disposed about the axis 101. The cylindrical cutouts 116 may be formed as bore holes and are of sufficient size to allow an energetic fill of a mine to enter an inner cavity of the projectile housing 110 after the projectile 100 impacts the mine. Cylindrical cutouts 116 may alternately be shaped as slots having sufficient size to allow the energetic fill of the mine to flow into the inner cavity of the projectile housing 110. The projectile 100 further comprises a fragmentation sleeve 210. The fragmentation sleeve 210 has an outer diameter sized to mate with an inner diameter of the projectile housing 110. The inner diameter of the fragmentation sleeve 210 is sized to allow the fragmentation sleeve to break apart and propel through the cutout sections 115 of the projectile housing 110 upon projectile detonation. In particular, the thickness of the wall of the fragmentation sleeve 210 are sufficiently small relative to the inner diameter of the fragmentation sleeve 210 to allow fragments to be expelled with sufficient velocity to cause the energetic fill of the mine to detonate. By way of example only, the fragmentation sleeve 210 may be comprised of 303 stainless steel and may have a thickness of approximately 0.005 inches. The fragmentation sleeve 210 may also include one or more vent holes 212 that allow air to escape as the energetic fill of the mine flows in to the fragmentation sleeve 210.

Still referring to FIG. 2, the projectile 100 further comprises a slider sleeve 220 which is inserted in the aft end of the projectile housing 110. An outer surface 223 of the slider sleeve 220 may be threaded to allow the slider sleeve 220 to be removably inserted into the aft end of the projectile housing 110. The slider sleeve 220 has an outer diameter sized to mate with the inner diameter of the aft end of the projectile housing 110. The slider sleeve 220 has an inner surface sized to receive a plurality of additional energetic components, as are discussed in greater detail herein. By way of example only the slider sleeve 220 may be comprised of AISI S7 tool steel. As shown, the finned section 120 of the projectile 100 also has a protrusion 201 that extends from the forward end of the finned section 120 and is involved in initiating detonation of the projectile 100. The finned section 120 may also have a threaded surface 124 located proximate the forward end of the finned section 120. The threaded surface 124 is adapted to allow the finned section 120 to be removably inserted into the aft end of the projectile housing 110.

Figure 3:
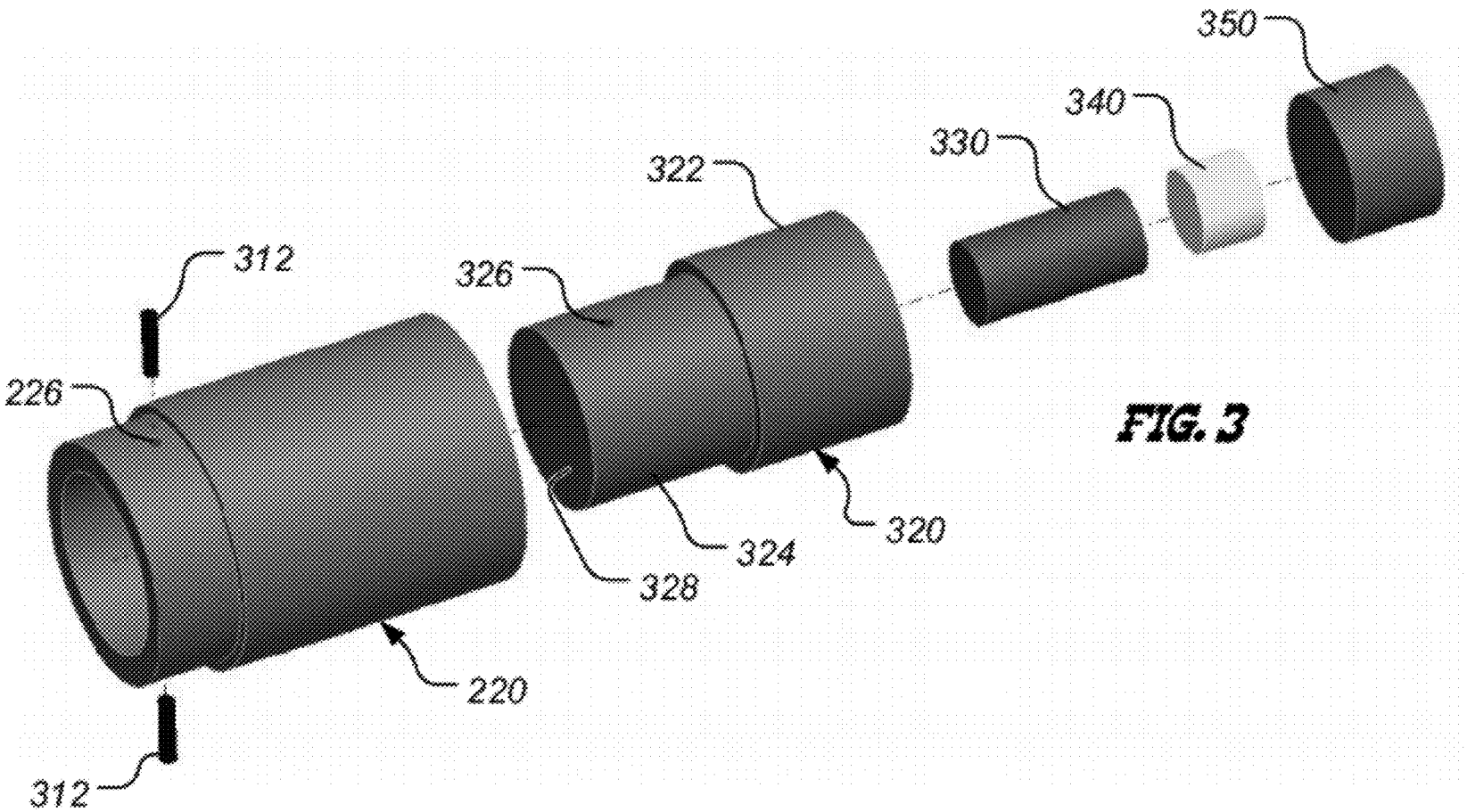
FIG. 3 is a diagram illustrating an exploded view of an exemplary slider sleeve in accordance with the exemplary projectile of FIG. 1.

Referring now to FIG. 3, a diagram is shown illustrating an exploded view of an exemplary slider sleeve 220 and elements disposed therein in accordance with the exemplary projectile 100 of FIG. 1. As shown, the slider sleeve 220 has a plurality of circular cutout sections 226 sized to receive a corresponding plurality of shear pins 312. By way of example only, two circular cutout sections 226 may be located on opposite sides of the slider sleeve 220. Two corresponding shear pins 312 may be employed for insertion into each of the circular cutout sections 226. The shear pins 312 may be comprised of high strength steel. The slider sleeve 220 also includes an energetic column slider 320 having a forward section 324 and an aft section 322. The outer diameter of the aft section 322 is larger than the outer diameter of the forward section 324. The outer surface of the energetic column slider 320 is sized to mate with an inner surface of the slider sleeve 220 and to allow the energetic column slider 320 to move freely relative to the slider sleeve 220. As shown, the energetic column slider 320 has a plurality of circular cutout sections 326, corresponding to the plurality of shear pins 312, also sized to receive the plurality of shear pins 312. The energetic column slider 320 also has a closed forward face 328 and a substantially hollow inner cavity sized to receive an insensitive energetic component 330, a sensitive energetic component 340, and a percussion primer 350, which define an explosive train. The aft end of the energetic column slider 320 is open to receive these energetic components. By way of example only, the energetic column slider 320 may be comprised of AISI 303 stainless steel. The insensitive energetic component 330 may be a high energy, insensitive explosive material, such as a combination of octagon and vinylidine fluoride-hexafluoropropene polymer, for example, PBXN-5, or the like. The sensitive energetic component 340 may be deflagration-to-detonation material, such as DXN-1 or the like. The percussion primer 350 may be a M42C2 primer or the like. Each of these energetic components has corresponding outer diameters that allow the energetic components to be pressed into the aft end of energetic column slider.

Figure 4A:
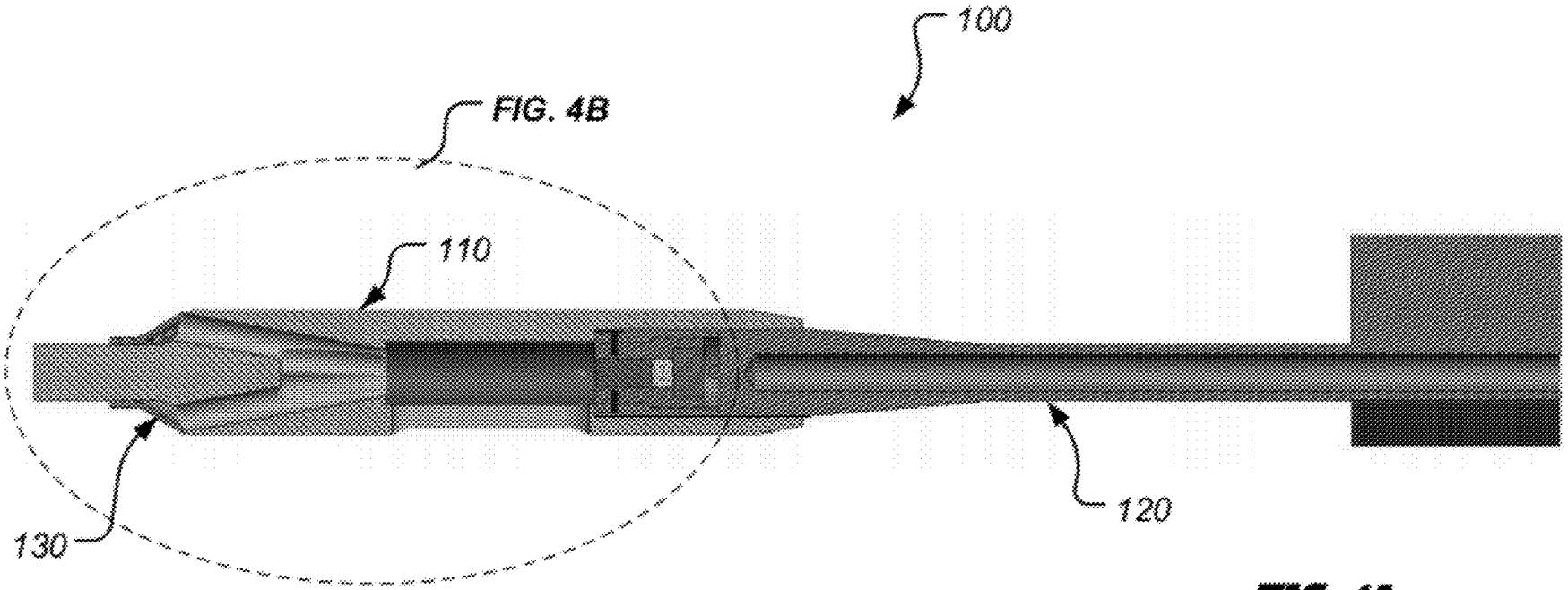
FIG. 4A is a diagram illustrating a cross-sectional view of the exemplary projectile of FIG. 1.
Figure 4B:
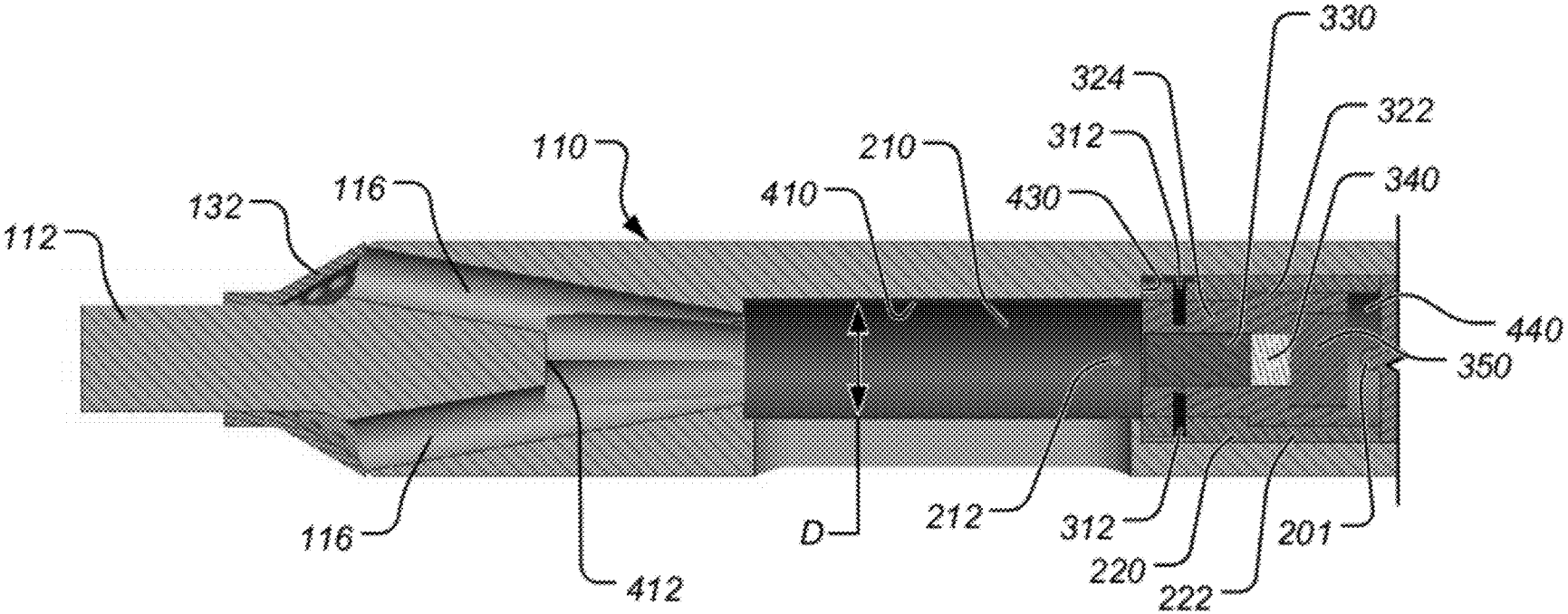
FIG. 4B is a diagram illustrating an enlarged view of a portion of the cross-sectional view of FIG. 4A.

Referring now to FIG. 4A and FIG. 4B, diagrams are shown illustrating a cross-sectional view of the exemplary projectile 100 of FIG. 1. FIG. 4B illustrates an enlarged view of a portion of projectile 100, as indicated in FIG. 4A. The projectile housing 110 includes an inner cavity labeled as 410. The inner cavity 410 is connected to the cylindrical cutout sections 116. As shown, the cylindrical cutout sections 116 are inwardly angled to connect to the inner cavity 410 of the projectile housing 110. A flat section 412 may also be included to reduce the likelihood that an internal component, such as the front surface 328 of the energetic column slider 320, will exit the projectile if an inadvertent detonation of the projectile occurs. One or more catches may also be included along the cylindrical cutout sections 116 in order to provide additional safety barriers without significantly impeding the flow of the energetic fill of the mine. As shown, the shear pins 312 secure the relative positions of the slider sleeve 220 and the energetic column slider 320. The forward face of the finned section 120 also secures the slider sleeve 220 in place against a shoulder section 430 of the inner surface of the projectile housing 110. The outer diameter of the aft section 322 of the energetic column slider 320 is larger than an inner diameter D of the projectile housing 110. In this manner the energetic column slider 320 is supported by the shoulder section 430 of the projectile housing 110 thereby preventing the shear pins 312 from being defeated as a result of external forces applied to the projectile 100. The energetic column slider 320 has an overall length shorter than that of the slider sleeve 220. As a result of the difference in overall length, along with the positioning of the shear pins 312, an offset gap 440 is formed between the aft end of the energetic column slider 320 and the forward face of the finned section 120 when the projectile 100 is assembled. The percussion primer 350 is sized so that the aft end of the percussion primer 350 is aligned with the aft end of the energetic column slider 320. In this manner the same offset gap 440 exists between the percussion primer 350 and the forward end of the finned section 120.

Still referring to FIGS. 4A and 4B, the protrusion 201 of the finned section 120 is located within the gap offset 440 when the projectile 100 is assembled. By way of example only, the protrusion 201 may be about 0.025 inches, measured from a forward end to an aft end. The offset gap 440 may be approximately 0.0625 inches measured from the aft end of the percussion primer 350 to the forward face of the finned section 120. A detonation sequence is initiated by impacting the percussion primer 350 with the protrusion 201. As configured, the offset gap 440 prevents the protrusion 201 from contacting the percussion primer 350 while shear pins 312 are intact. The shear pins 312 may be defeated only by application of an aftward force applied at the forward surface of the energetic column slider 320. Since the energetic column slider 320 is located within the projectile housing 110, the need for a separate safe and arm mechanism is advantageously eliminated. Operation of the exemplary projectile 100 during an exemplary mine-impact scenario will now be discussed with reference to FIGS. 5A-5D.

Figure 5A:
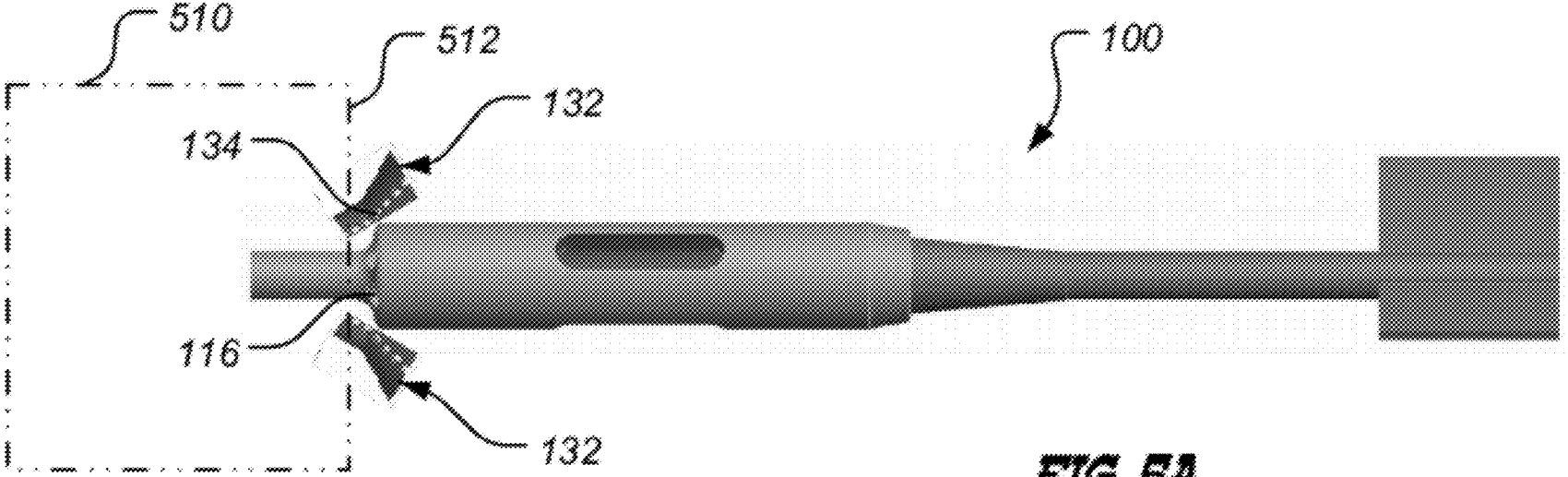
FIG. 5A is a diagram illustrating operation of the exemplary projectile of FIG. 1 during an exemplary mine impact scenario.

FIG. 5A is a diagram illustrating operation of the exemplary projectile 100 of FIG. 1 during an exemplary mine impact scenario. In the exemplary scenario a projectile 100 impacts a surface 512 of mine 510, after having traveled through one or more media, such as water, air and/or sand. Note that in FIGS. 5A-5D, mine 510 is represented in phantom to better reveal the exemplary operational characteristics of the projectile 100. The frangible barrier 130 substantially prevents entry of such media into the inner cavity 410 of the projectile housing 110. The frangible barrier 130 is also adapted to be of sufficient structural integrity to remain intact while traveling through such media. In this manner, premature detonation of the projectile is prevented. The frangible barrier 130 is, however, also adapted to break apart upon impacting a material of sufficient hardness, such as a metal mine housing. When attempting to defeat mines having a plastic housing, the frangible barrier 130 will be adapted to break apart upon impact with the energetic fill, such as TNT, of the mine. FIG. 5A illustrates the manner in which the frangible barrier 130 will break apart, in effect zippering apart at seams defined by the perforations 134 from an aft end to a forward end of the frangible barrier 130. After the frangible barrier 130 breaks away from the projectile housing 110, cylindrical cutouts 116 are exposed allowing the energetic fill of the mine to flow into the projectile housing 110.

Figure 5B:
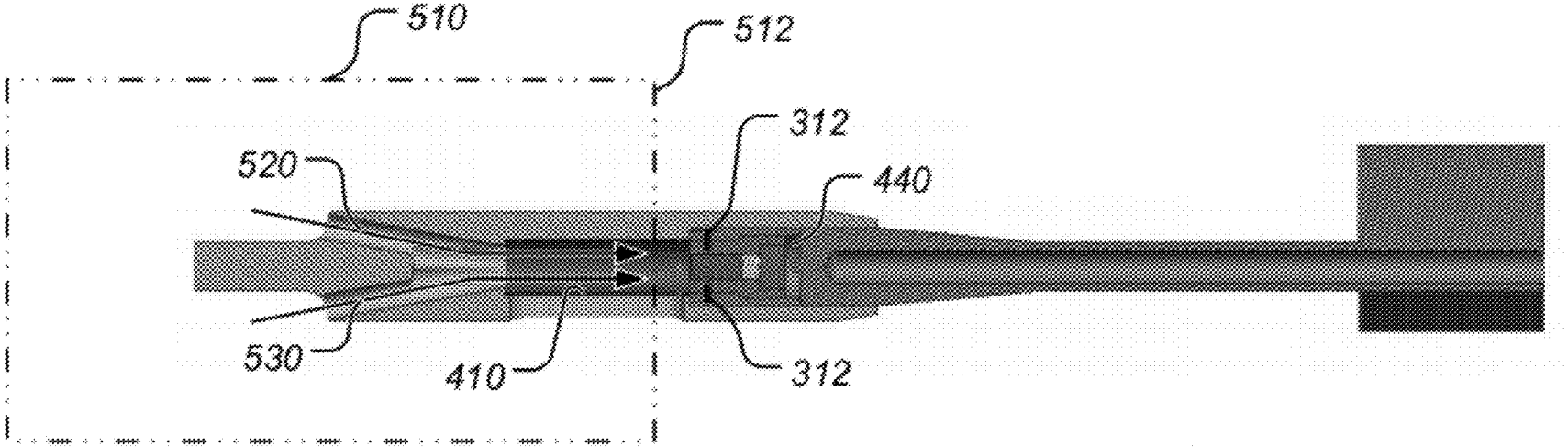
FIG. 5B is a diagram illustrating operation of the exemplary projectile of FIG. 1 during an exemplary mine impact scenario.

Referring now to FIG. 5B, another diagram is shown illustrating operation of the exemplary projectile 100 of FIG. 1 during an exemplary mine impact scenario. In particular, FIG. 5B illustrates the flow of the energetic fill of the mine into the projectile housing 110 as the projectile penetrates deeper (relative to FIG. 5A) into the mine. The flow of the energetic fill through the cylindrical cutout sections 116 and into the inner cavity 410 of the projectile housing is indicated by arrows 520 and 530. At this point in time, the energetic fill has begun to flow into the inner cavity 410 but has yet to impact the forward face of the energetic column slider 320. As such, the shear pins 312 remain intact and the offset gap 440 is still in place.

Figure 5C:
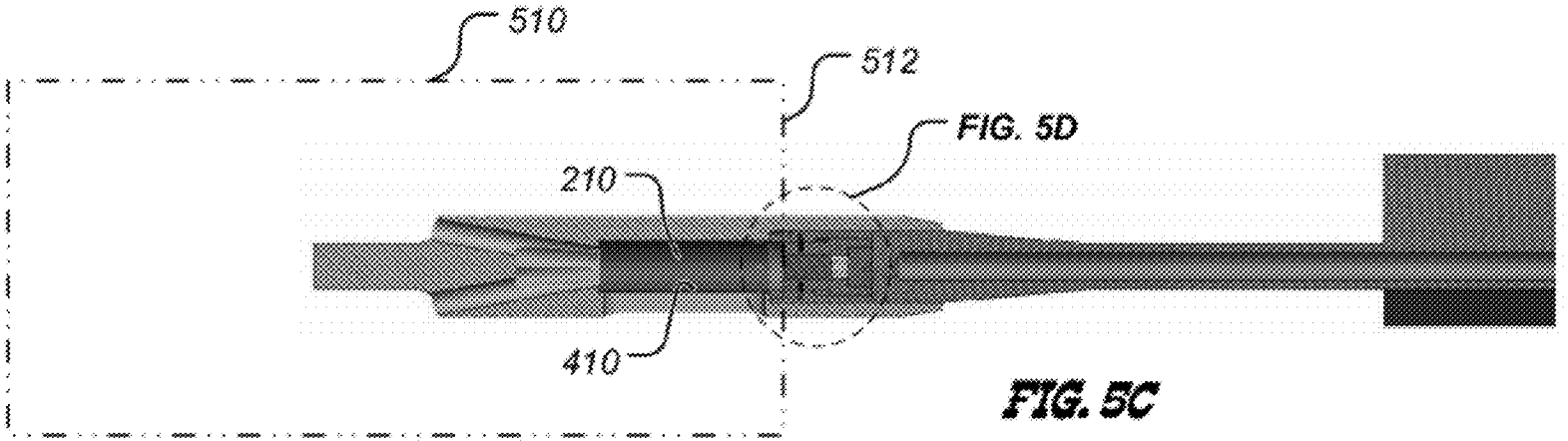
FIG. 5C is a diagram illustrating operation of the exemplary projectile of FIG. 1 during an exemplary mine impact scenario.
Figure 5D:
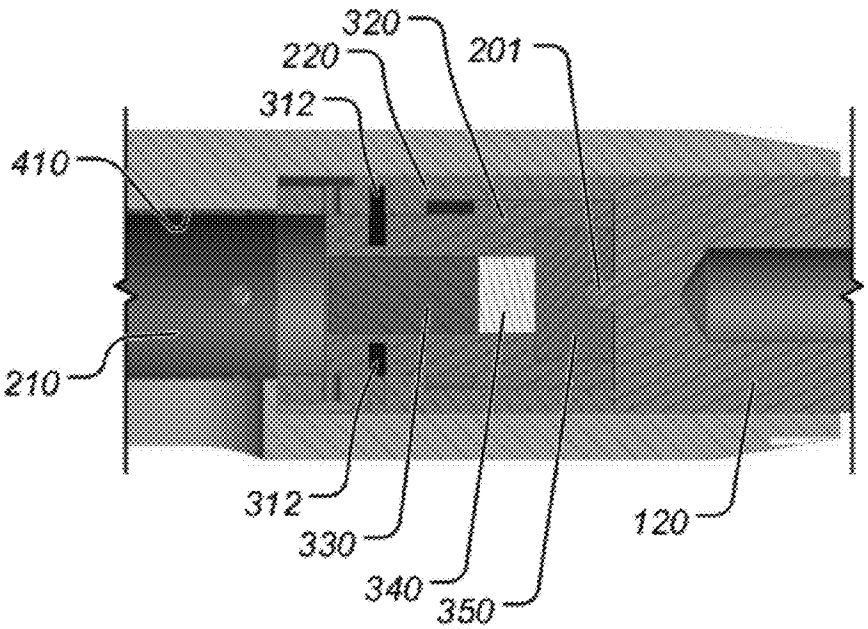
FIG. 5D is a diagram illustrating operation of the exemplary projectile of FIG. 1 during an exemplary mine impact scenario.

Referring now to FIG. 5C and FIG. 5D, diagrams are shown illustrating operation of the exemplary projectile of FIG. 1 during an exemplary mine impact scenario. FIG. 5D illustrates an enlarged view of a portion of projectile 100, as indicated in FIG. 5C. In particular, FIG. 5C and FIG. 5D illustrate the state of the projectile shortly after the energetic fill of the mine has impacted the forward face 328 of the energetic column slider 320. As shown, the shear pins 312 are defeated as a result of the aftward force caused by the mass flow rate of the energetic fill of the mine entering the inner cavity 410. After the shear pins 312 are defeated the force of the energetic fill pushes the energetic column slider 320 along with energetic components 330, 340 and 350 aftward. The offset gap 440 closes and the percussion primer 350 impacts the protrusion 201 of the finned section 120 of the projectile 100. In this manner, the protrusion 201 acts as a firing pin that initiates detonation of the energetic components of the projectile 100. Initiation of the percussion primer 350 initiates the higher energy sensitive energetic component 340. Initiation of the sensitive energetic component 340 in turn causes the high explosive energetic component 330 to detonate. At this point, the inner cavity 410 of the projectile housing 110, surrounded by fragmentation sleeve 210, has filled with the energetic fill of the mine. Detonation of the high explosive energetic component 330 will in turn initiate detonation of the energetic fill of the mine that is encased within the inner cavity 410. Initiation of the energetic fill of the mine located within the inner cavity 410 will cause the fragmentation sleeve 210 to break apart expelling fragmented sections through the cutout sections 115 of the projectile housing 110. The expelled fragmented sections of the fragmentation sleeve 210 in turn initiate detonation of the energetic fill of the mine. High order detonation or deflagration of the mine fill may also be initiated by allowing the detonation wave within the inner cavity 410 of the projectile 100 to travel forward through the cylindrical cutouts 116 into the adjacent mine fill. Since the energetic material of the mine is used to initiate this fragmentation, the amount of insensitive high explosive material 330 required to detonate the mine can advantageously be reduced relative to existing mine-defeating projectiles. By way of example only, the amount of insensitive high explosive material may be about 0.05 grams. Reducing the amount of insensitive material to such a level along with the novel construction of the projectile advantageously eliminates the need for a separate safe and arm mechanism. The projectile 100 can be initiated in a human hand and by modern safety standards is considered to be "hand safe".

According to embodiments of the present invention the mine-defeating projectile having described herein provides a small-scale projectile capable of defeating land mines without the need for a safe and arm mechanism.

The present invention provide significant advantages including, but not limited to, (1) providing a projectile that includes only a small amount of explosive but is effective in defeating mines and (2) providing a projectile that requires no safe and arm mechanism but is effective in defeating mines.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A mine defeating projectile, comprising:

a housing defining an inner cavity, a plurality of channels extending through a front surface of the housing and to the inner cavity, and a plurality of cutout sections extending through a side wall thereof;

a fragmentation sleeve disposed in the inner cavity of the housing;

a slider sleeve disposed in the inner cavity of the housing abutting an aft end of the fragmentation sleeve, the slider sleeve including an explosive train, the slider sleeve being frangibly attached to the housing; and a finned section attached to an aft end of the housing, the finned section defining a protrusion for initiating the explosive train, the protrusion being spaced apart from the explosive train.

2. The mine defeating projectile of claim 1, wherein the housing includes a nose section defining closed, generally flat forward face.

3. The mine defeating projectile of claim 2, wherein the forward face is configured to supercavitate as the projectile travels through water or to create a terra-dynamic cavity when traveling through earthen materials.

4. The mine defeating projectile of claim 1, wherein the housing includes a nose section and the mine defeating projectile further comprises a frangible barrier disposed about an aft end the nose section for inhibiting water, air, or earthen materials from entering the plurality of channels defined by the housing until the projectile impacts a material of predetermined hardness.

5. The mine defeating projectile of claim 4, wherein the frangible barrier includes a plurality of sections separated by perforations.

6. The mine defeating projectile of claim 4, wherein the frangible barrier is configured to break apart upon impacting at least one of a material of a predetermined hardness, a metal mine housing, or an energetic fill of a mine.

7. The mine defeating projectile of claim 1, wherein the explosive train comprises:

an insensitive energetic component;

a sensitive energetic component; and a percussion primer that is initiated by impact with the protrusion.

8. The mine defeating projectile of claim 7, wherein the insensitive energetic component comprises a combination of octagen and vinylidine fluoride-hexafluoropropene polymer.

9. The mine defeating projectile of claim 7, wherein the sensitive energetic component comprises a deflagration-to-detonation material.

10. The mine defeating projectile of claim 1, further comprising an energetic column slider in which the explosive train is disposed, the energetic column slider being affixed in the slider sleeve.

11. The mine defeating projectile of claim 10, wherein the frangible attachment of the slider sleeve and the housing is configured to be defeated when an energetic fill of a mine impacts a forward face of the energetic column slider, resulting in the explosive train contacting and being initiated by the protrusion.

12. The mine defeating projectile of claim 1, further comprising a plurality of shear pins, wherein the housing and the slider sleeve define corresponding openings in which the shear pins are received to frangibly affix the slider sleeve in the housing.

13. The mine defeating projectile of claim 12, further comprising an energetic column slider in which the explosive train is affixed, the energetic column slider defining a plurality of openings corresponding to the plurality of opening defined by the slider sleeve, wherein the energetic column slider is disposed within the slider sleeve and the plurality of shear pins are received in the plurality of openings defined by the energetic column slider.

14. The mine defeating projectile of claim 13, wherein the explosive train comprises a percussion primer that is initiated by impact with the protrusion.

15. The mine defeating projectile of claim 1, wherein the fragmentation sleeve is configured to fragment, such that fragments of the fragmentation sleeve are expelled through the plurality of cutout sections defined by the housing.

16. A mine defeating projectile, comprising:

a housing having a blunt nose section defining a generally flat forward face, the housing defining an inner cavity, a plurality of channels extending into the inner cavity, and a plurality of cutout sections extending through a side wall thereof;

a frangible barrier disposed about an aft end the nose section;

a fragmentation sleeve disposed in a forward end of the inner cavity of the housing;

a slider sleeve disposed in the inner cavity of the housing abutting an aft end of the fragmentation sleeve;

an energetic column slider disposed in the slider sleeve, the energetic column slider defining a cavity therein;

an insensitive energetic component retained in a forward end of the cavity defined by the energetic column slider;

a sensitive energetic component retained adjacent the insensitive energetic component;

a percussion primer retained adjacent the sensitive energetic component;

a finned section defining a protrusion extending from a forward face thereof, the finned section attached to the housing; and a plurality of shear pins engaged with the housing, the slider sleeve, and the energetic column slider, such that the percussion primer is spaced away from the protrusion.

* * * * *